US005588222A

United States Patent [19]

Thompson

[11] Patent Number: 5,588,222

[45] Date of Patent: Dec. 31, 1996

[54] PROCESS FOR RECYCLING COMBUSTION GASES IN A DRYING SYSTEM

[75] Inventor: Stanley P. Thompson, Topeka, Kans.

[73] Assignee: Beloit Technologies, Inc., Beloit, Wis.

[21] Appl. No.: 404,589

[22] Filed: Mar. 15, 1995

[51] Int. Cl.[6] ..... F26B 7/00

[52] U.S. Cl. ..... 34/379; 34/423; 34/467; 34/477; 34/487; 34/514; 432/72; 110/216

[58] Field of Search ..... 34/85, 86, 467, 34/476, 477, 479, 487, 513, 514, 79, 359, 360, 363, 364, 370, 373, 379, 423; 110/216, 245; 432/72, 59

[56] References Cited

U.S. PATENT DOCUMENTS

| | | | |
|---|---|---|---|
| 3,861,055 | 1/1975 | Thompson | 34/363 |
| 4,445,976 | 5/1984 | La Delfa et al. | 34/363 |
| 5,295,310 | 3/1994 | Eriksson | 34/487 |

*Primary Examiner*—John M. Sollecito

*Assistant Examiner*—Steve Gravini

*Attorney, Agent, or Firm*—Shook, Hardy & Bacon L.L.P.

[57] ABSTRACT

In a process for drying material in a drying system, a first current of heated gas is supplied to a first dryer from a corresponding first combustion chamber. Material to be dried is exposed to the first current in the first dryer. The dried material is separated from the first current of heated gas. The first current of heated gas is split into a first stream of heated gas and a second stream of heated gas after the dried material has been separated. The first stream is introduced into the first combustion chamber so that the gas generated in the first combustion chamber and the first stream are combined to constitute the first current of heated gas. At least a portion of the second stream is introduced into the second combustion chamber. A second current of heated gas is supplied to a second dryer from the second combustion chamber. The portion of the second stream introduced into the second combustion chamber constitutes a portion of the second current. Material to be dried is exposed to the second current in the second dryer. The dried material is separated from the second current.

12 Claims, 1 Drawing Sheet

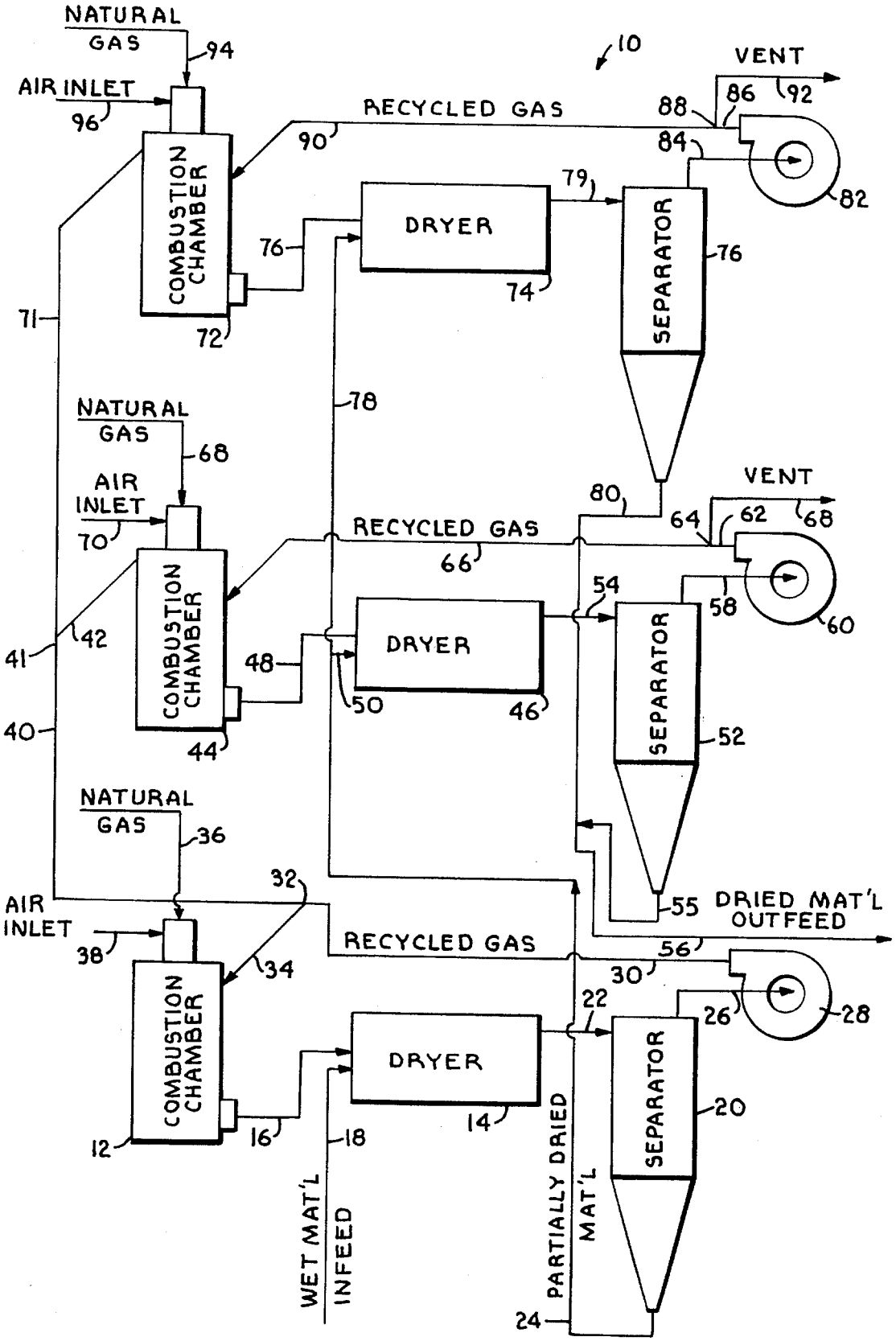
NATURAL GAS
94
AIR INLET
96
COMBUSTION CHAMBER
72
71
RECYCLED GAS
90
10
VENT
86
92
88
84
82
DRYER
74
76
79
SEPARATOR
76
78
NATURAL GAS
68
AIR INLET
70
COMBUSTION CHAMBER
44
41
42
40
RECYCLED GAS
66
80
VENT
64
62
68
DRYER
46
48
50
54
58
60
SEPARATOR
52
NATURAL GAS
36
AIR INLET
38
COMBUSTION CHAMBER
12
34
32
RECYCLED GAS
55
DRIED MAT'L OUTFEED
56
30
26
28
DRYER
14
16
18
22
SEPARATOR
20
WET MAT'L INFEED
PARTIALLY DRIED MAT'L
24

PROCESS FOR RECYCLING COMBUSTION GASES IN A DRYING SYSTEM

BACKGROUND OF THE INVENTION

This invention relates to a process for use in a drying system wherein combustion gases are recycled through the drying system prior to being vented to the atmosphere.

Drying systems are important features in the manufacture and processing of many different materials. For example, drying systems are often used to dry wood chips during the manufacturing of particle board. Further, drying systems are of particular importance during the processing of ethanol. More particularly, after ethanol has been removed from grain during the fermentation process, it is then desirable to dry the grain to allow storage and resale of the grain for animal feed or other uses.

Typical drying systems include a combustion chamber into which natural gas and air are supplied and combusted. The heated combustion gases in the combustion chamber are then induced by a draft fan into a rotating cylindrical dryer. The material to be dried is introduced into the dryer and exposed to the current of heated gases. The dried material is then separated from the heated gas current in a cyclone separator. The remaining heated gases are then vented to the environment. An example of a typical drying system of the prior art is disclosed in U.S. Pat. No. 3,861,055, which is incorporated herein by reference.

Numerous problems and disadvantages are associated with these prior art drying systems. A major problem involves the venting of the combustion gases to the atmosphere. More particularly, these combustion gases contain various pollutants. For example, the gases oftentimes contain volatile organic compounds (VOC's), carbon dioxide ($CO_2$), and nitrous oxide ($N_2O$). In addition to pollutants that result from the combustion process in the combustion chamber, pollutants can also result from the drying of the material itself. For example, when drying grain used to produce ethanol, a small percentage of the ethanol remains in the grain and is evaporated during the drying process. Thus, this evaporated ethanol becomes part of the heated stream of gases exiting the dryer and entering the atmosphere. Because of governmental standards that set the level of pollutants that can be vented to the atmosphere, it is often necessary to add additional pollution control devices to the drying systems to reduce the pollutant levels in the gas stream prior to venting. These devices often are add-on oxidizers which oxidize the VOC's present in the gas stream to reduce the VOC's to an acceptable level. These pollution control devices are typically expensive to install and operate.

Another disadvantage associated with prior art drying systems and processes involves the fire hazard associated with excessive amounts of oxygen ($O_2$) in the combustion gases. More particularly, in order to convey the material to be dried through the dryer, a large volume of moving gas is needed. This is especially true when the material contains a large percentage of moisture. Typically, drying systems make up the necessary volume by introducing excess air during the combustion process in the combustion chamber. Although this results in a suitable volume gases to convey the materials, it also results in an excessive amount of $O_2$ in the combustion gases. In many instances, the amount of $O_2$ exceeds the allowable fire and explosion standards. The use of large amounts of excess air also results in other problems with these drying systems. More particularly, increasing the excess air admitted to the combustion chamber results in a decrease in the temperature of the combustion gases exiting the burner.

In order to reduce the amount of $O_2$ in the combustion gases and increase the temperature level of the combustion gases to a suitable level for drying, attempts have been made to decrease the amount of excess air introduced into the combustion chamber. However, reducing the amount of excess air results in various other inherent disadvantages with the drying system. More particularly, as is apparent, decreasing excess air results in a lower volume of gas flowing through the drying chamber. This can result in ineffective and/or unstable pneumatic conveying of the product through the drying system. Further, oftentimes the excess air is decreased to raise the temperature of the exiting combustion gases above the normal drying level in order to compensate for the decreased volume of gases moving through the drying chamber. This elevated temperature, however, can result in thermal degradation of the material being dried. Further, as the temperature of the combustion gases is raised higher and higher, the amount of the pollutant $N_2O$ and the amount of VOC's dramatically increases. $N_2O$ is an especially undesirable and difficult to treat pollutant.

Some prior art drying processes use more than one dryer to ensure that the material is adequately dried. In these processes, the moisture content of the material is reduced in a first dryer to a particular level using a medium range temperature, and then completely dried in additional dryers also using medium range temperatures. This type of drying process, although producing adequate drying results at medium range temperatures, may still produce large amounts of pollutants. In other prior art drying systems having a single combustion chamber and a single dryer, attempts have been made to recycle the entire quantity of combustion gases exiting the dryer back to the combustion chamber. However, because the entire quantity of combustion gases was recycled, these systems often had to operate within very narrow operating parameters. If the system was ever operated outside these narrow parameters, the efficiency and operation of the system were adversely affected. For example, the combustion process could be interfered with if the system strayed outside the parameters.

Therefore, a drying process is needed that oxidizes pollutants within the system so that external pollution control devices are not needed. Further, a drying process is needed which decreases the amount of $O_2$ present in the system to a level below fire standards without affecting the efficiency of the dryer due to the lack of available conveying gases. Still furthermore, a drying process is needed which will maintain a suitable temperature that limits the production of $N_2O$ as a pollutant and limits thermal degradation of the dried material.

SUMMARY OF THE INVENTION

One object of the present invention is to reduce the emission of pollutants from a drying process into the atmosphere.

Another object of the present invention is to internally reduce the pollutant emission level of a drying process to a level that is below set governmental standards. This reduction of emissions eliminates the need for using expensive emission control devices in conjunction with a drying system.

Another object of the present invention is to reduce the amount of oxygen in the drying process so that even in upset conditions when the drying process is operated outside normal conditions, a wider margin of safety exists to reduce potential fire and explosion hazards.

A further object of the present invention is to recycle a portion of the combustion gases from a first dryer back to the combustion chamber coupled to the first dryer and recycle another portion of the combustion gases from the first dryer to a further combustion chamber associated with an additional dryer. This recycling of combustion gases to the combustion chambers results in oxidation of and resulting reduction of the amount of organic pollutants remaining in the combustion gases.

A still further object of the present invention is the use of recycled combustion gases instead of excess air as conveying gases for propelling the material to be dried through the dryers.

Another object of the present invention is to use the recycled gas to control the temperature in the combustion chambers to maintain the temperature within a desired range to prevent the unwanted production of $N_2O$ and to prevent unwanted thermal degradation of the dried product.

Additional objects, advantages, and novel features of the invention will be set forth in part in the description which follows and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawing, which forms a part of the specification and is to be read in conjunction therewith, is a diagrammatic view of a drying system utilizing the process of the present invention.

FIG. 1 is a diagrammatic view of a drying system utilizing the process of the present invention.

DETAILED DESCRIPTION OF THE PREFERRED EMBODIMENTS

With reference to the drawing, a drying system 10 utilizing the process of the present invention is shown diagrammatically. A combustion chamber 12 supplies a current of heated gas to a dryer 14, as indicated by the reference numeral 16. Wet material to be dried is also introduced into dryer 14 as indicated by the reference numeral 18. In dryer 14 the wet material is exposed to the heated gas current so that the moisture content of the material is reduced to a predetermined level. It has been found advantageous to reduce the moisture content of the material to approximately 50% in dryer 14. The current of heated gas flowing through dryer 14 serves to convey the wet material therethrough.

After the moisture content of the material has been reduced in dryer 14, the material and the current of heated gases are conveyed, as indicated by the reference numeral 22, to a separator 20. In separator 20, the partially dried material is separated from the heated gases. The partially dried material exits separator 20 as indicated by the reference numeral 24. This material will be further dried in additional dryers, as will be further described below. The heated gas current also exits separator 20 as is indicated by the reference numeral 26. The current then is conveyed to fan 28. The current exits from fan 28 as indicated by the reference numeral 30. The current of heated gas exiting fan 28 is then split at point 32 into two separate streams. One stream 34 is conveyed back to combustion chamber 12. Natural gas and air, as indicated by the reference numerals 36 and 38, respectively, are also introduced into combustion chamber 12. The natural gas and the air are combusted in the combustion chamber. The combustion gases generated in chamber 12 are combined with the stream of recycled gas 34 to form current 16 of heated gas conveyed to dryer 14. As will be more fully explained below, the temperature of the stream 34 of recycled gas introduced into combustion chamber 12 is elevated so that many of the pollutants in the recycled gas are oxidized.

The other stream formed by the splitting of the current of recycled gas at point 32 is indicated by the reference numeral 40. A portion 42 of this stream 40 is split at point 41 and is introduced into an additional combustion chamber 44. A current of heated gas is conveyed, as indicated by the reference numeral 48, to an additional dryer 46. Additionally, a portion 50 of the partially dried material exiting separator 20 is conveyed to dryer 46. As with dryer 14, the current of heated gases from combustion chamber 44 is exposed to the partially dried material within dryer 46 so that the moisture content of the material is reduced and attains a substantially dried condition. The current of heated gases and the fully dried material exit dryer 46 together and are conveyed, as indicated by the reference numeral 54, to an additional separator 52. As with separator 20, in separator 52 the dried material is separated from the current of heated gases. The dried material exits separator 52 as indicated by the reference numeral 55 and exits the system as indicated by the reference numeral 56. The current of heated gases exits separator 52 as indicated by the reference numeral 58 and is conveyed to an additional fan 60. The current of heated gases exits fan 60 as indicated by the reference numeral 62. The current exiting fan 60 is split into two different streams at point 64. One of these streams, as indicated by the reference numeral 66, is recycled back to combustion chamber 44. The other stream 68 is vented to the environment.

In combustion chamber 44, natural gas and air are introduced, as indicated by the reference numerals 68 and 70, respectively, and combusted. The combustion gases generated therefrom are combined with stream 42 of recycled gas from dryer 14 and stream 66 of recycled gas from dryer 46 to form the current 48 of heated gases exiting combustion chamber 44 and conveyed to dryer 46. As with combustion chamber 12, the temperatures of streams 42 and 66 of recycled gas are raised to such a level as to allow oxidation of pollutants.

Another portion 71 of stream 40 from dryer 14 is conveyed to combustion chamber 72. A current of heated gas is supplied from combustion chamber 72 to dryer 74 as is indicated by the reference numeral 76. Further, a portion of the partially dried material exiting separator 20 is conveyed, as is indicated by the reference numeral 78, to dryer 74. As with dryer 46, the partially dried material is exposed to the current of heated gases in dryer 74 to completely dry the material. The dried material and the current of heated gases are conveyed, as indicated by the reference numeral 79, from dryer 74 to another separator 76. As with separators 20 and 52, the dried material is separated from the current of heated gases in separator 76. The dried material exits separator 76, as indicated by the reference numeral 80, and exits the drying system as indicated by the reference numeral 56. The current of heated gases are conveyed from separator 76 to fan 82 as indicated by the reference numeral 84. The current of heated gases exits the fan 82 as indicated by the reference numeral 86. The current exiting fan 82 is split into two separate streams at point 88. One stream 90 is recycled back to combustion chamber 72. The other stream 92 is vented to the environment. Natural gas and air are introduced into combustion chamber 72, as indicated by the reference numerals 94 and 96, respectively, and are combusted therein. The combustion gases formed combine with stream 71 of recycled gas from dryer 14 and stream 90 of recycled gases from dryer 74 to form the current of heated gases 76 exiting chamber 72 and entering dryer 74. As with combustion chamber 44, the temperatures of the recycled gas streams 71 and 90 are elevated so that pollutants within the gas streams can be oxidized.

In the system described above, it has been found advantageous to make the dryers 14, 46, and 74 of a rotating cylindrical type wherein the dried material is mixed with the currents of heated gases in a rotating motion. Further, the separators 20, 52, and 76 are preferably of a cyclone separator type.

As described above, the recycling of combustion gases back to the combustion chambers of the above system results in a reduction in the amount of pollutants that are vented to the environment by the system. More particularly, the combustion gases generated in combustion chamber 12 are recycled so that a portion returns to combustion chamber 12, a portion is introduced into combustion chamber 44, and a portion is introduced into combustion chamber 72. Additionally, a portion of the combustion gases generated in combustion chamber 44 is recycled back to combustion chamber 44 and the remaining portion is vented to the atmosphere. The combustion gases generated in combustion chamber 72 are treated in the same way as the combustion gases generated in combustion chamber 44.

The combustion gases generated by the combustion of natural gas and air contain high amounts of volatile organic compounds (VOC's). In addition to VOC's generated by the combustion of natural gas and air, in certain applications, VOC's are generated in the dryers. More particularly, in the production of ethanol, ethanol remaining in the fermented grain is evaporated off in the drying process. In order to stay below governmental standards set for venting of VOC's to the environment, it is necessary to reduce the total VOC's resulting from the drying process. The reintroduction of the combustion gases back into the combustion chambers results in further oxidation of the VOC's, and thus reduction in the amount of VOC's vented to the atmosphere. It has been found advantageous to increase the temperature of the recycled gas introduced into the various combustion chambers to approximately 1200° F. This temperature has been found to result in adequate oxidation of VOC's so that the combustion gases can be vented to the environment without treatment.

In the production of ethanol, it has been found that a majority of the VOC's will be evaporated in the initial drying of the material. That is, a majority of the VOC's will be evaporated in dryer 14 and the remainder evaporated in dryers 46 and 74. Because of this fact, it is advantageous to recycle all of the gases exiting dryer 14 in order to burn off the VOC's. Consequently, all the gases exiting dryer 14 and separated from the partially dried material are recycled back to combustion chambers 12, 44 or 72, as described above. Further, because not as many VOC's are generated in dryers 46 and 74, at least a portion of the gases passing through these dryers can be vented to the atmosphere.

In the process of drying wood chips, different drying characteristics are present. More specifically, a majority of the VOC's resulting from drying of wood chips are generated during the latter drying stages and not during the initial drying stages. Thus, for example, for the system described above, it may be advantageous to first partially dry wet material in dryers 46 or 74. That is, the wet material would be separated into two portions, one going to dryer 46 and the other to dryer 74. After the portions are partially dried in dryers 46 or 74, both material portions can then be conveyed to dryer 14 for final drying. With this material supply arrangement, a portion of the VOC's generated in the initial drying stages, that is in dryers 46 and 74, will be vented to the atmosphere. However, the majority of the VOC's, which are generated in the final drying stage in dryer 14, would all be recycled back to be burned in combustion chambers 12, 44 or 72.

As is apparent, the particular material handling arrangement for the drying system of the present invention can be modified in order to optimize the system for a particular product or material.

In addition to the reduction of pollutants, it is advantageous to use he recycled combustion gas as the conveying gases to convey the material to be dried through the dryers. More particularly, the recycled gas stream 34 entering combustion chamber 12 when combined with the combustion gases generated in chamber 12 allows for sufficient volume of gases to move the wet material through dryer 14. It has been found that if all of the recycled gas from dryer 14 is returned to combustion chamber 12, the drying system must operate within very narrow operating parameters in order to not adversely affect the efficiency and operation of the system. Therefore, it is necessary to split the current of recycled gas from dryer 14 so that only a portion of the current returns to combustion chamber 12, as described above. Thus, the other portion of the current goes to the other combustion chambers 44 and 72 to remove the VOC's from that portion.

By using the recycled gas as the conveying gas, the amount of excess air introduced into the system can be reduced. Reducing the amount of excess air results in less $O_2$ being present in the combustion gases. Reducing the amount of $O_2$ present in the combustion gases is desirous in order to prevent the $O_2$ content from becoming higher than governmental fire and explosion standards. Typically, the fire standards specify that the amount of $O_2$ with respect to the total of all combustion gases should be below 13% on a dry basis.

In addition to providing an adequate volume of conveying gas, the recycled gas also serves to regulate the temperature of the gas currents entering the dryers. By introducing recycled gas into each of the combustion chambers, the temperature of the combustion gases generated in the chambers is lowered. This thermal reduction prevents thermal degradation of the material being dried and reduces formation of the pollutant $N_2O$. The quantity of recycled gas introduced determines to what degree the combustion gases are lowered. Thus, by regulating the quantity of recycled gases introduced into the combustion chambers, the temperature within the chamber can be maintained at a particular level. This temperature level being high enough to allow adequate drying of the product and low enough to prevent thermal degradation and reduce formation of $N_2O$.

It has been found to be very desirous to set up the process of the present invention within certain parameters to maximize the reduction of pollutants, maintain the drying process within fire and explosion standards, and to allow for effective and efficient drying of the material without thermal degradation of the material. One such parameter involves a ratio of the evaporation rates of the dryers. More particularly, it has been found advantageous to have the ratio of the amount of water evaporated in dryer 14 to the amount of water evaporated in dryers 46 and 74 be approximately in the range of 1:2 to 1:1, and preferably within the range of 4:7 to 3:4. For example, for the preferred range, if 20,000 lbs. of water per hour are evaporated in dryer 14, then dryers 46 and 74 should preferably evaporate approximately 35,000 to 27,000 lbs. of water per hour combined. It is preferable to split equally the amount evaporated in dryers 46 and 74 so that 17,500 to 13,500 lbs. of water are evaporated in each. Another advantageous parameter involves the temperature of the currents of heated gases 16, 48, and 76 entering their respective dryers. More particularly, it has been found advantageous that the temperature of these currents be within the range of 900° F. to 1800° F. This temperature range results in adequate drying of the material in the dryers without thermal degradation thereof. This range is also below the temperature level that results in formation of $N_2O$.

The above parameters are used to determine the quantity of recycled gases returned to the combustion chambers. That is, the evaporation rate ratios and the temperature parameters are maintained by adjusting the quantity of the streams of recycled gases at the points 32, 41, 64, and 88 where the currents of gases are split so that the ratios and temperatures are maintained. It has been found that generally the amount of the recycled gas from dryer 14 that is returned to combustion chamber 12 is approximately in the range of 50% to 90% of the total quantity of the current of heated gases 30 exiting fan 28. The remaining stream of recycled gas 40 from dryer 14 is preferably split equally between combustion chambers 44 and 72.

Utilizing the above parameters allows a drying process to be obtained that will oxidize pollutants within the system so that internal pollution control devices are not needed. Further, by utilizing the recycled gas as conveying gas for the material to be dried, the amount of $O_2$ present in the system can be kept to a level that is below fire standards without affecting the efficiency of the dryer due to the lack of conveying gases. Still further, a suitable temperature will be maintained within the dryers. This temperature allows maximum drying of the material without thermal degradation of the material and a reduction in the formation of $N_2O$ that results from excessively high temperatures.

As is apparent, the process of the present invention can be utilized with two or more dryers, and is not limited to the embodiment described above and depicted in the drawing. Thus, the parameters discussed above can also be used to provide the advantageous results described above even if the process is used with only two dryers or with four or more dryers. So long as the drying process is set up such that the ratio of the evaporation rate of the first dryer to the combined evaporation rates of any additional dryers is within the range of 1:2 to 1:1, and the temperature of the current of gases entering the dryers is within the range of 900° F. to 1800° F., the drying system will operate to maximize drying efficiency, to maximize reduction of pollutants, and to maintain the process within fire standards.

Having described the invention, what is claimed is:

1. A process for drying material in a drying system having a first stage dryer and at least two second stage dryers, the first and second stage dryers each having a combustion chamber coupled therewith, the process comprising:

supplying a quantity of heated gas to the first stage dryer from the combustion chamber coupled therewith;

exposing material ton be dried to said quantity of heated gas in the first stage dryer;

separating dried material from said quantity of heated gas;

splitting said quantity of heated gas into a first stream of heated gas and a second stream of heated gas after dried material has been separated from said quantity of heated gas;

introducing said first stream into the combustion chamber coupled with the first stage dryer so that the gases generated in this combustion chamber and said first stream are combined to constitute said quantity of heated gas;

introducing at least a portion of said second stream into each combustion chamber coupled with a second stage dryer;

supplying each second stage dryer with a current of heated gas from the combustion chamber coupled therewith, said portion of said second stream constituting a portion of each said current;

exposing material to be dried to said current in a second stage dryer; and separating dried material from said current.

2. The process of claim 1 further comprising:

splitting each said current into a recycle stream of heated gas and a vent stream of heated gas after dried material has been separated from said current;

introducing said recycle stream into the combustion chamber from which said current originated so that the gases generated in that combustion chamber, said portion of said second stream and said recycle stream are all combined to constitute said current of heated gas for the second stage dryer coupled with that combustion chamber; and venting said vent stream to the atmosphere.

3. The process of claim 2 wherein the ratio of the evaporation rate of the first stage dryer to the evaporation rate of the second stage dryers combined is approximately in the range of 1:2 to 1:1, and wherein the quantity of the streams of heated gas are adjusted with respect to each other so that the temperature of said quantity of heated gas as it enters the first stage dryer and the temperature of said currents of heated gas as they enter the second stage dryers are all in the range of approximately 900° F. to 1800° F.

4. A process for drying material in a drying system having at least a first dryer and a second dryer, said dryers each having a combustion chamber coupled thereto, the process comprising:

supplying a first current of heated gas to the first dryer from the first combustion chamber;

exposing material to be dried to said first current in the first dryer;

separating dried material from said first current of heated gas;

splitting said first current into a first stream of heated gas and a second stream of heated gas after dried material has been separated from said first current;

introducing said first stream into the first combustion chamber so that the gases generated in the first combustion chamber and said first stream are combined to constitute said first current of heated gas;

introducing at least a portion of said second stream into the second combustion chamber;

supplying a second current of heated gas to the second dryer from the second combustion chamber, said portion of said second stream constituting a portion of said second current;

exposing material to be dried to said second current in the second dryer; and separating dried material from said second current.

5. The process of claim 4 further comprising:

splitting said second current into a third stream of heated gas and a fourth stream of heated gas after dried material has been separated from said second current;

introducing said third stream into the second combustion chamber so that the gases generated in the second combustion chamber, said portion of said second stream and said third stream are all combined to constitute said second current of heated gas; and venting said fourth stream to the atmosphere.

6. The process of claim 5 including a third dryer and a combustion chamber coupled thereto, the process further comprising:

supplying a third current of heated gas to the third dryer from the third combustion chamber;

exposing material to be dried to said third current in the third dryer;

separating dried material from said third current;

splitting said third current into a fifth stream of heated gas and a sixth stream of heated gas after dried material has been separated from said third current;

introducing another portion of said second stream into the third combustion chamber;

introducing said fifth stream into the third combustion chamber so that the gases generated in the third combustion chamber, said other portion of said second stream and said fifth stream are all combined to constitute said third current of heated gas; and venting said sixth stream to the atmosphere.

7. The process of claim 6 wherein the ratio of the evaporation rate of the first dryer to the evaporation rate of the second and third dryers combined is approximately in the range of 1:2 to 1:1, and wherein the quantity of the streams of heated gas are adjusted with respect to each other so that the temperature of said first current as it enters the first dryer, the temperature of said second current as it enters the second dryer, and the temperature of said third current as it enters the third dryer are all in the range of approximately 900° F. to 1800° F.

8. The process of claim 4 wherein the quantity of said first stream of heated gas is approximately in the range of 50% to 90% of the quantity of said first current of heated gas.

9. The process of claim 5 further comprising:

supplying wet material to the first dryer and partially drying the material therein; and supplying at least a portion of the partially dried material from the first dryer to the second dryer and further drying the material therein.

10. The process of claim 6 further comprising:

supplying wet material to the first dryer and partially drying the material therein;

supplying at least a portion of the partially dried material from the first dryer to the second dryer and further drying the material therein; and supplying another portion of the partially dried material from the first dryer to the third dryer and further drying the material therein.

11. The process of claim 5 further comprising:

supplying wet material to the second dryer and partially drying the material therein; and supplying at least a portion of the partially dried material from the second dryer to the first dryer and further drying the material therein.

12. The process of claim 6 further comprising:

supplying a first portion of wet material to the second dryer and partially drying the material therein;

supplying a second portion of wet material to the third dryer and partially drying the material therein; and supplying both the first and second portions of partially dried material to the first dryer and drying both portions therein.

* * * * *